United States Patent [19]

Deal

[11] Patent Number: 4,718,438

[45] Date of Patent: Jan. 12, 1988

[54] FILTER CIGARETTE HAVING ROTATABLE ADJUSTMENT

[75] Inventor: Philip A. Deal, Winston-Salem, N.C.

[73] Assignee: R. J. Reynolds Tobacco Company, Winston-Salem, N.C.

[21] Appl. No.: 895,397

[22] Filed: Aug. 11, 1986

[51] Int. Cl.[4] ..... A24D 3/04

[52] U.S. Cl. ..... 131/336; 131/198.2

[58] Field of Search ..... 131/336, 198.2, 198.1

[56] References Cited

U.S. PATENT DOCUMENTS 4,527,573 7/1985 Haaserman ..... 131/336

4,600,027 7/1986 Houck et al. ..... 131/336

4,601,298 7/1986 Nichols et al. ..... 131/336

*Primary Examiner*—V. Millin

[57] ABSTRACT

An adjustable delivery filter cigarette includes a tobacco rod and a filter element having two layers of circumscribing plug wrap. The layer of plug wrap nearest the filter element is glued to the filter element. The overlying layer of plug wrap forms three bands about the filter element. The central band is rotatable. Tipping material having an air permeable region acts to attach the wrapped plug to the tobacco rod. Rotation of the central band allows for varying degrees of registry between regions of permeability in the two layers of plug wrap.

3 Claims, 6 Drawing Figures

FILTER CIGARETTE HAVING ROTATABLE ADJUSTMENT

BACKGROUND OF THE INVENTION

This invention relates to smoking articles such as filter cigarettes, and in particular to such smoking articles having means for rotatable adjustment.

Cigarettes having adjustable regions have become subjects of increasing interest, particularly in situations wherein the adjustment of the air dilution value of filter cigarettes is desired. Known methods for providing adjustments to the air dilution value of filter cigarettes generally involve making one or more openings through a substantially air impermeable filter plug wrap, through the substantially air impermeable tipping paper and through a corresponding sleeve which is placed over the tipping paper, which sleeve is movable either rotatably or axially in order to select the degree to which the sets of openings are in registry.

Numerous known methods for providing adjustments to the air dilution value of filter cigarettes suffer from various problems. For example, a movable sleeve may be easily inadvertently removed from the cigarette by the smoker and not readily replaced. Furthermore, the degree of registry between the sets of openings can be inadvertently destroyed by slight axial movement of the sleeve. Accordingly, the air dilution value, once set by the smoker, is not insured to any degree of consistency.

U.S. Pat. No. 4,532,943 to Nichols et al proposes a filter cigarette having a filter plug having a mouthend segment and a tobacco rod end segment, wherein the two segments are axially connected for rotation about the longitudinal axis of the cigarette. Typically, in such a filter, the two segments are defined by a circumferential cut in the filter plug. However, a cigarette having a means for adjustment which does not require a segmented filter for rotation is clearly desirable.

U.S. Pat. No. 4,570,649 to Nichols et al proposes a variable dilution filter cigarette wherein the filter plug includes a circumscribing wrap in the form of three bands. The bands at the mouthend and rod end of the filter plug are attached to the filter, and the central band is rotatable about the plug. Tipping paper in the form of two bands attaches the filter plug to the rod while providing for rotation of the plug such that an opening in the rod end band of the plug wrap can be positioned in varying degrees of alignment with an opening in the tipping paper. However, the filter cigarette proposed in U.S. Pat. No. 4,570,649 to Nichols et al has a limited degree of rotation. In addition, manufacture of such a filter requires additional equipment to rotate the filter element into the full flavor position after the air dilution slots or vents are provided. Furthermore, cutting of filter tow within a filter is not particularly desirable in certain applications.

It would be highly desirable to provide a filter cigarette having an easily settable, rotatably adjustable filter region being capable of having unlimited rotational ability. In addition, it would be highly desirable to provide a filter cigarette having an adjustable filter region, which cigarette is relatively easy to manufacture at a commercial scale.

SUMMARY OF INVENTION

This invention relates to a filter cigarette comprising in combination a rod of smokable material (i.e., a tobacco rod), an axially aligned filter plug having an air permeable filter element and two layers of circumscribing wrapping material, and tipping material circumscribing the filter plug and an adjacent portion of the rod. The filter element has a rod end and a mouthend each open to permit the passage of air and smoke therethrough, and is circumscribed by a first layer of wrapping material fixedly secured thereto, and the wrapped filter element is circumscribed by a second layer of wrapping material having, in sequence, abutting mouthend, central and rod end bands. The mouthend and rod end bands are fixedly secured to the underlying first layer of wrapping material, and the central band is rotatable about the longitudinal axis of the cigarette. The rotatable central band has a region of substantial air impermeability and a region of air permeability therein, each of which regions can be rotated into varying degrees of registry with a region of air impermeability and a region of air permeability in the underlying portion of the first layer. The tipping material is provided in two segments. The first segment is fixedly secured to and extends from the rod thereby overlying the rod end band and central band, and being fixedly secured only to the central band to join the rod to the filter plug. The first segment of tipping material has a region of air permeability therein at least in the region thereof which overlies the air permeable region of the central band. The second segment of tipping material overlies and is fixedly secured to the mouthend band of the filter plug. The lateral regions of the cigarette circumscribed by the mouthend and rod end bands are substantially air impermeable, and rotation of the filter plug relative to the rod provides for varying degrees of registry of the substantially air impermeable regions and air permeable regions of each of the first layer and the central band.

This invention also relates to a filter cigarette comprising in combination a rod of smokable material, an axially aligned filter plug having an air permeable filter element and circumscribing wrapping material, and tipping material circumscribing the filter plug and an adjacent portion of the rod. The filter element has a rod end and a mouthened each open to permit the passage of air and smoke therethrough, and has fixedly secured thereto a first layer of substantially air impermeable wrapping material such that the wrapping material partially circumscribes the filter element thereby providing a partially wrapped filter element having a substantially air impermeable region and an air permeable region, and the partially wrapped filter element is circumscribed by a second layer of wrapping material having, in sequence, abutting mouthend, central and rod end bands. The mouthend and rod end bands are fixedly secured to the underlying region of the plug, and the central band is rotatable about the longitudinal axis of the cigarette. The rotatable central band overlies the first layer over the longitudinally extending length of the band, and has a region of substantial air impermeability and a region of air permeability therein, each of which regions can be rotated into varying degrees of registry with the region of the filter element not covered by the first layer. The tipping material is provided in two segments. The first segment is fixedly secured to and extends from the rod thereby overlying the rod end band and central band and being fixedly secured only to the central band to join the rod to the filter plug. The first segment of tipping material has a region of air permeability therein at least in the region thereof which overlies the air permeable region of the central band.

The second segment of tipping material overlies and is fixedly secured to the mouthend band of the filter plug. The lateral regions of the cigarette circumscribed by the mouthend and rod end bands are substantially air impermeable, and rotation of the filter plug relative to the rod provides for varying degrees of registry of the substantially air impermeable regions and air permeable regions of each of the partially wrapped filter element and the central band.

The present invention provides an efficient and effective means for manufacturing filter cigarettes having adjustable air delivery capabilities. In particular, filter cigarettes having adjustable air delivery capabilities can be manufactured in a low air dilution/high delivery setting while employing conventional cigarette manufacturing equipment.

The user of a cigarette of this invention can easily rotate the filter end of the cigarette about the longitudinal axis thereof and relative to the tobacco rod in order to vary the degree of radial alignment or registry between the air permeable region of the first layer of plug wrap and the air permeable region of the central band, and hence vary the air dilution capabilities of the cigarette. The degree of registry can vary continuously from a position of substantially disalignment of air permeable regions wherein the combination of central band and underlying first layer function to provide a substantially air impermeable region with respect to air dilution; to a position of substantially complete alignment of air permeable regions wherein the combination of central band and underlying first layer function to provide maximum air dilution capabilities to the cigarette.

As used herein, the term "air dilution" is the ratio of the volume of air drawn through the air dilution openings or vents (i.e., through the air permeable region) to the total volume of air and smoke drawn through the smoking article and exiting the extreme mouthend portion of the smoking article.

DETAILED DESCRIPTION OF THE EMBODIMENTS

Figure 1:
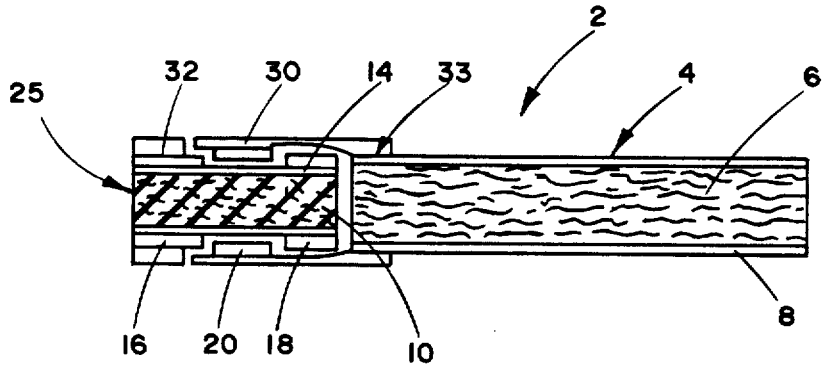
FIG. 1 is a diagrammatic cross sectional illustration of a portion of a cigarette showing a portion of the rod, the filter element, first layer of wrapping material, the second layer of wrapping material in the form of three bands, and the tipping material having two segments.
Figure 2:
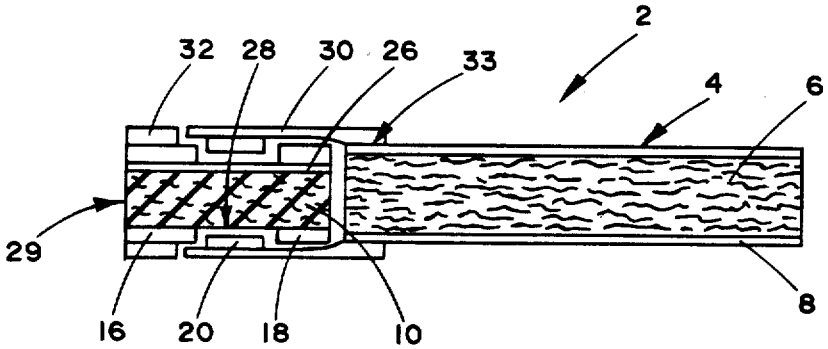
FIG. 2 is a diagrammatic cross sectional illustration of a portion of a cigarette showing a portion of the rod, the filter element, first layer of wrapping material extending along the length of and partially circumscribing the filter element, the second layer of wrapping material in the form of three bands, and the tipping material.

Embodiments of this invention shown in FIGS. 1 and 2 are smoking articles in the form of a filter cigarette 2.

The filter cigarette includes a generally cylindrical rod 4 of smokable material 6 contained in wrapping material 8. Rod 4 is typically referred to as a "tobacco rod." Typically, the smokable material is a charge of tobacco, processed tobacco, reconstituted tobacco, tobacco substitutes, and blends thereof; and the wrapping material is a conventional cigarette paper wrap. Typically, the rod has a length which ranges from about 55 mm to about 85 mm, and a circumference which ranges from about 20 mm to about 26 mm.

Referring to FIG. 1, rod 4 is axially aligned in a substantially abutting end-to-end relation with generally cylindrical filter element 10. The filter element can be constructed from any air permeable filter material such as cellulose acetate, or the like. Filter element 10 is circumscribed by wrapping material 14 thereby forming the first layer of wrapping material around (i.e., enveloping) the filter element and along the longitudinally extending length of the filter element. The wrapping material can be a conventional plug wrap material such as paper plug wrap, or the like. Typically, wrapping material 14 is fixedly secured to filter element 10 using an adhesive material, such as a glue, or the like. A second layer of wrapping material circumscribes the first layer of wrapping material 14. The wrapping material of the second layer can be a conventional plug wrap material such as paper plug wrap, or the like. The second layer includes a mouthend band 16, a rod end band 18 and a central band 20 positioned in the region between the mouthend band and the rod end band. The second layer thereby includes substantially abutting mouthend, central and rod end bands in sequence. The filter element having two layers of circumscribing wrapping material is referred to as filter plug 25. The inner regions of each of mouthend band 16 and rod end band 18 are fixedly secured to the outer surface of first layer of wrapping material 14 using an adhesive material such as glue, or the like. The central band is rotatable about the longitudinal axis of the filter plug. Preferably, the diameter of the filter plug 25 substantially equals the diameter of the rod; and the length approximates that of a conventional filter plug.

Referring to FIG. 2, rod 4 is axially aligned in a substantially abutting end-to-end relation with generally cylindrical filter element 10, filter element 10 is partially circumscribed by wrapping material 26 which extends along the longitudinally extending length of the filter element. The partially circumscribing wrap covers a portion of the surface of the filter element while a portion of the surface of the filter element is left uncovered thereby providing air permeable region 28. The wrapping material is a substantially air impermeable material such as nonporous paper plug wrap, or the like. Preferably, the wrapping material 26 circumscribes at least about 40 percent more preferably at least about 50 percent of the total circumferential distance around the filter element. The second layer of wrapping material circumscribes the first layer of wrapping material 26 and the air permeable region 28 of the filter element 10. The wrapping material of the second layer can be a conventional plug wrap material such as paper plug wrap, or the like. The second layer includes a mouthend band 16, a rod-end band 18 and a central 20 positioned in the region between the mouthend band and the rod-end band. The second layer thereby includes substantially abutting mouthend, central and rod-end bands in sequence. The filter element having two layers of circumscribing wrapping material (i.e., a partially circumscribing first layer and a circumscribing second layer) is referred to as filter plug 29. The inner regions of each of mouthend band 16 and rod-end band 18 are fixedly secured to the outer surface of the first layer of wrapping material 26 and exposed air permeable region 28 of the filter element using an adhesive material such as glue, or the like. The central band is rotatable about the longitudinal axis of the filter plug. Preferably, the diameter of the filter plug 29, substantially equals the diameter of the rod.

Referring again to FIGS. 1 and 2, first segment tipping material 30 (i.e., the end-to-end segment) circumscribes (i.e., envelopes) the region of the rod 4 adjacent the filter plug 25 or 29 and at least rod end band 18 and central band 20. Preferably, the first segment of tipping material extends a sufficient distance along the length of the cigarette to circumscribe a portion of the length of mouthend band 16. Second segment of tipping material 32 (i.e., the mouthend segment) circumscribes the remaining length of mouthend band 16. Each of first segment 30 and second segment 32 of tipping material substantially abut one another.

The inner surface of first segment of tipping material 30 is fixedly secured to the outer surface of the rod 4 at surface region 33 of the rod; and to the outer surface of central band 20 of the second layer of wrap of the filter plug 25 or 29. The inner surface of the second segment of tipping material 32 is fixedly secured to the outer surface of rod-end band 16 of the second layer of wrap of the filter plug.

The mouthend band 16, the central band 20 and the rod-end band 18 each individually extend over a portion of the total length of the filter plug. The length of each individual segment along the filter plug can vary depending upon factors such as the surface area required for the desired air dilution, convenience of adjustment to the desired air dilution setting, the strength required to maintain attachment of the filter plug to the tobacco rod, and other such factors. Typically, a central band having a longitudinally extending length of from about 30 percent to about 50 percent of the total length of the filter plug can provide for firm attachment of the band to the tobacco rod while allowing for the desired air dilution capabilities. Typically, a mouthend band having a longitudinally extending length of from about 30 percent to about 50 percent of the total length of the filter plug can provide a suitable mouthpiece region while allowing for a region for the user to grasp when adjusting the smoking article. Typically, the rod-end band has the shortest longitudinally extending length of the three bands.

In operation, wrapped plug 25 or 29 is rotatable about the longitudinal axis of the cigarette 2. In particular, the cigarette can be grasped at the mouthend portion thereof in the vicinity of the second segment 32 of tipping material and the vicinity of the rod 4. The filter plug 25 or 29 can be thereby rotated freely relative to the rod. The abutment of central band 20 against each of mouthend band 16 and rod-end band 18 provide an effective means for maintaining the filter plug and the rod in a substantially abutting end-to-end relation thereby preventing the filter plug from readily being pulled away from and out of contact from the rod. The frictional resistance to rotation of the central band 20 relative to the rest of the cigarette insures that the desired setting is maintained.

Process steps for providing the filter cigarettes of this invention are digrammatically illustrated in FIGS. 3 through 6.

Figure 3:
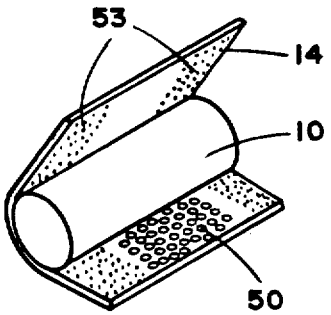
FIG. 3 is a fragmentary perspective of a filter element during a step in the manufacture of a filter plug.

In FIG. 3, cylindrical filter element 10 is wrapped in substantially air impermeable plug wrap 14 which ultimately provides the so-called first layer of the filter plug. The plug wrap has a region 50 of air permeability therein such as a plurality of perforations or holes, a series of slits or vents, a partially circumferentially extending slit or opening, or the like. The plurality of perforations can be provided to the wrapping material "off-line" from the cigarette manufacturing steps using techniques such as a timed and positioned electrostatic perforating means, or the like. The region of air permeability in the substantially air impermeable plug wrap is provided such that when the first layer of plug wrap circumscribes the filter element, the wrapped element has both a circumferentially extending region of air permeability and a circumferentially extending region of substantial air impermeability about a region circumferentially extending around the wrapped element. The plug wrap 14 is draped around and fixedly secured to the filter element by adhesive 53 applied to the inner surface of the plug wrap 14. Preferably, no adhesive is applied over region 50 of air permeability in order that air can freely pass through the perforations into the filter element.

Figure 4:
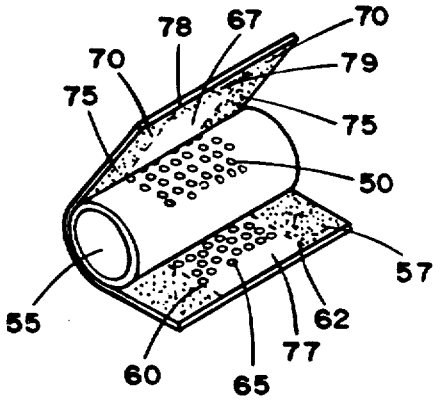
FIG. 4 is a fragmentary perspective of a filter plug.

In FIG. 4, the wrapped filter element 55 is further wrapped in substantially air impermeable second plug wrap 57 having two rows of perforations 60 and 62 therein. The second plug wrap 57 has a region 65 of air permeability in a region thereof which ultimately forms the central band of the filter plug. The region 65 of air permeability is provided such that when the second layer of plug wrap circumscribes the wrapped filter element 55, the doubly wrapped filter plug has both a circumferentially extending region 65 of air permeability and a circumferentially extending region 67 of substantial air impermeability about a region circumferentially extending around the filter plug. Preferably, during manufacture the region 65 of air impermeability of the second layer of wrap is positioned so as to overlie the region 50 of air permeability of the first wrap, thereby providing for a filter plug in the low or non air dilution configuration. The plug wrap 57 is draped around and fixedly secured to the wrapped filter element 55 by adhesive 70 applied over the regions 75 and 76 which ultimately provide the mouthend and rod-end bands, respectively. Preferably, no adhesive is applied to the inner surface of second plug wrap at the region 77 which ultimately provides the central band thereby allowing free rotation of the central band about the longitudinal axis of the filter plug. Typically, adhesive 78 is applied to lap zone 79 of region 77 of the second plug wrap in order that the necessary central band can be formed. The filter plug so produced includes first layer of wrap fixedly secured to the filter element, mouthend and rod-end bands fixedly secured to the first layer of wrap, and freely rotatable central band positioned between the mouthend and rod-end bands. The central band is freely rotatable when the rows of perforations 60 and 62 of the second plug wrap are broken thereby providing the three individual segments. The wrapped plug can be provided by a rod-making unit equipped with two webs of filter plug wrap.

Figure 5:
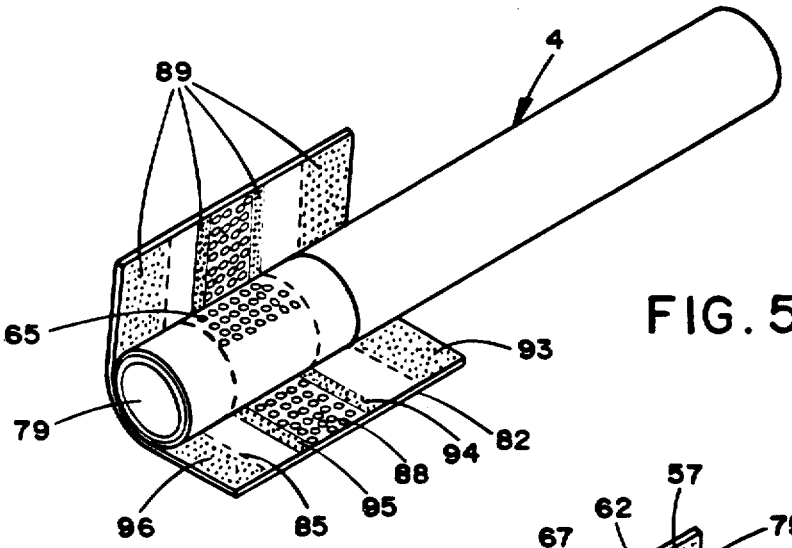
FIG. 5 is a partially fragmentary perspective of a filter cigarette of this invention.

In FIG. 5, the wrapped filter plug 79 is axially aligned with tobacco rod 4 and attached thereto using tipping material 82. The tipping material has a row of perforations 85 therein. The tipping material 82 has a region 88 of air permeability in a region thereof which ultimately overlies region 65 of air permeability of the central band of the filter plug. For convenience, the region 88 of air permeability in the tipping material can extend such that the region 88 totally circumscribes the filter plug when the tipping material is draped around the filter plug.

The tipping material 82 is draped around and fixedly secured to the filter plug by adhesive 89 applied to the inner surface of the tipping material over regions 93, 94, 95 and 96, respectively. Adhesive 89 over region 93 provides attachment of the tipping material to the tobacco rod 4 adhesive 89 over regions 94 and 95 provides attachment of the tipping material to the central band. Preferably, strips or ribbons of adhesive which provide regions 94 and 95 cover only a portion of region 88 such that a substantial portion of the portion providing air permeability remains unobstructed. Adhesive 89 over region 96 provides attachment of the tipping material to the mouthend band. The row of perforations 82 is broken thereby providing two segments (or bands) of tipping material which allow for the rotation of the filter plug relative to the rod. Such a wrapped plug can be provided by a rod-making unit equipped with two webs of filter plug wrap.

Figure 6:
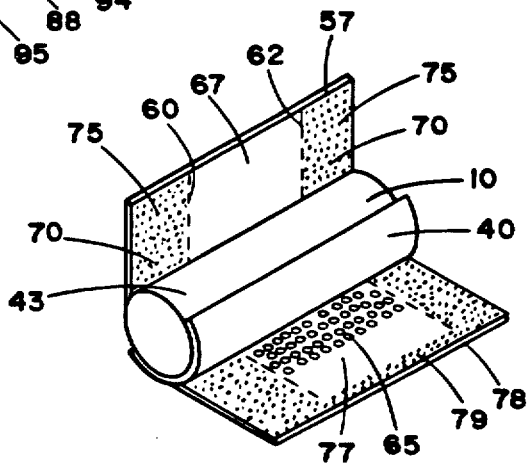
FIG. 6 is a fragmentary perspective of another embodiment of a filter plug.

In FIG. 6, cylindrical filter element 10 is partially circumscribed along the length thereof by substantially air impermeable wrapping material 40. The wrapping material is fixedly secured to filter element by an adhesive such as glue, or the like, applied to the inner surface of the wrapping material 40. The wrapped filter element so provided has a longitudinally extending substantially air impermeable surface region and longitudinally extending air permeable region 43. The air permeable region of the filter element is the portion of filter element not covered by the wrapping material 40. The wrapped filter element is further wrapped in substantially air impermeable second plug wrap 57 having two rows of perforations 60 and 62 therein. The second plug wrap 57 has a region 65 of air permeability in a region thereof which ultimately forms the central band of the filter plug. The region 65 of air permeability is provided such that when the second layer of plug wrap circumscribes the wrapped filter element, the doubly wrapped filter plug has both a circumferentially extending region 65 of air permeability and a circumferentially extending region 67 of substantial air impermeability about a region circumferentially extending around the filter plug. Preferably, during manufacture the region 65 of air impermeability of the second layer of wrap is positioned so as to overlie the region 43 of air permeability of the filter element, thereby providing for a filter plug in the low or non air dilution configuration. The plug wrap 57 is draped around and fixedly secured to the filter element by adhesive 70 applied over the regions 75 and 76 which ultimately provide the mouthend and rod-end bands, respectively. Preferably, no adhesive is applied to the inner surface of second plug wrap at the region 77 which ultimately provides the central band thereby allowing free rotation of the central band about the longitudinal axis of the filter plug. Typically, adhesive 78 is applied to lap zone 79 of region 77 of the second plug wrap in order that the necessary central band can be formed. The filter plug so produced includes first layer of wrap fixedly secured to the filter element, mouthend and rod-end bands fixedly secured to the first layer of wrap and the exposed surface of the filter element, and freely rotatable central band positioned between the mouthend and rod-end bands. The central band is freely rotatable when the rows of perforations 60 and 62 of the second plug wrap are broken thereby providing the three individual segments. The resulting filter plug is attached to the tobacco rod using tipping material substantially as previously described for the other embodiment.

An advantage of the configuration of this invention shown in FIG. 1 includes the ability to wrap the two layers of plug wrap in opposite directions with respect to one another. Such a wrapping configuration prevents the lap edge of the first layer of wrap from butting into the lap edge of the second layer of wrap during rotation of the filter plug relative to the rod.

What is claimed is:

1. A filter cigarette comprising in combination a rod of smokable material, an axially aligned filter plug having an air permeable filter element and circumscribing wrapping material, and tipping material circumscribing the filter plug and an adjacent portion of the rod, wherein (i) the filter element has a rod end and a mouthend each open to permit the passage of air and smoke therethrough, and has fixedly secured thereto a first layer of substantially air impermeable wrapping material such that the wrapping material partially circumscribes the filter element thereby providing a partially wrapped filter element having a substantially air impermeable region and an air permeable region, and the partially wrapped filter element is circumscribed by a second layer of wrapping material having, in sequence, abutting mouthend, central and rod end bands;

(ii) the mouthend and rod end bands are fixedly secured to the underlying region of the plug, and the central band is rotatable about the longitudinal axis of the cigarette;

(iii) the central band is rotatable relative to the filter element and overlies the first layer over the longitudinally extending length of the band, and has a region of substantial air impermeability and a region of air permeability therein, each of which regions can be rotated into varying degrees of registry with the region of the filter element not covered by the first layer;

(iv) the tipping material is provided in two segments wherein (a) the first segment is fixedly secured to and extends from the rod thereby overlying the rod end band and central band and is fixedly secured only to the central band to join the rod to the filter plug, and (b) the second segment overlies and is fixedly secured to the mouthend band;

(v) the tipping material has a region of air permeability therein at least in the region thereof which overlies the air permeable region of the central band;

(vi) the lateral regions of the cigarette circumscribed by the mouthend and rod end bands are substantially air impermeable; and (vii) rotation of the filter plug relative to the rod provides for varying degrees of registry of the substantially air impermeable regions and air permeable regions of each of the partially wrapped filter element and the central band.

2. The cigarette of claim 1 wherein the wrapping material is paper wrap.

3. The cigarette of claim 2 wherein the filter element is manufactured from cellulose acetate tow.

* * * * *

UNITED STATES PATENT AND TRADEMARK OFFICE
CERTIFICATE OF CORRECTION

PATENT NO. : 4,718,438
DATED : January 12, 1988
INVENTOR(S) : Philip A. Deal

It is certified that error appears in the above-identified patent and that said Letters Patent are hereby corrected as shown below:

Please add the following U.S. Patent Documents and Foreign Patent Document as references cited on the title page of the above-identified Letters Patent:

--U.S. PATENT DOCUMENTS

| | | | |
|---|---|---|---|
| 4,532,943 | 6/1985 | Nichols et al | 131/336 |
| 4,570,649 | 2/1986 | Nichols et al | 131/336 |

FOREIGN PATENT DOCUMENTS

| | | | |
|---|---|---|---|
| 107507 | 5/1984 | EPO | A24D--. |

Signed and Sealed this
Twenty-first Day of June, 1988

*Attest:*

*Attesting Officer*

DONALD J. QUIGG

*Commissioner of Patents and Trademarks*